US007087875B2

(12) United States Patent
Cho et al.

(10) Patent No.: US 7,087,875 B2
(45) Date of Patent: Aug. 8, 2006

(54) WALL-MOUNTED MICROWAVE OVEN

(75) Inventors: Sung Wook Cho, Seoul (KR); Hong Man Jang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/887,878

(22) Filed: Jul. 12, 2004

(65) Prior Publication Data

US 2005/0173428 A1 Aug. 11, 2005

(30) Foreign Application Priority Data

Jan. 19, 2004 (KR) ..... 10-2004-0003738

(51) Int. Cl.
*H05B 6/64* (2006.01)

(52) U.S. Cl. ..... 219/757; 219/756

(58) Field of Classification Search ..... 219/757, 219/756, 400, 686, 681, 683, 702; 126/21 A, 126/21 R, 299 R, 299 D, 39 R, 110 R, 237 R, 126/273 R, 190; 312/296; 248/674, 222.11, 248/222.12, 222.14

See application file for complete search history.

(56) References Cited

U.S. PATENT DOCUMENTS

| | | | | |
|---|---|---|---|---|
| 4,313,043 | A * | 1/1982 | White et al. | 219/757 |
| 4,327,274 | A * | 4/1982 | White et al. | 219/757 |
| 6,369,372 | B1 * | 4/2002 | Kim | 219/756 |
| 6,717,122 | B1 * | 4/2004 | Roh | 219/756 |

FOREIGN PATENT DOCUMENTS

| | | |
|---|---|---|
| JP | 60-263019 | 12/1985 |
| JP | 61-280322 | 12/1986 |

* cited by examiner

*Primary Examiner*—Quang Van
(74) *Attorney, Agent, or Firm*—Staas & Halsey LLP

(57) ABSTRACT

A wall-mounted microwave oven in which a bottom plate adapted to be mounted to a lower end of an oven body is easily detachable. The wall-mounted microwave oven includes a coupling unit for mounting the bottom plate to the lower end of the oven body. The coupling unit includes a plurality of engagement slots formed through the lower end of the oven body at positions spaced apart from one another, respectively, and a plurality of engagement hooks provided on the bottom plate at positions corresponding to the positions of the engagement slots, and adapted to be engaged with the engagement slots in a state of being inserted into the engagement slots, respectively. Since the mounting of the bottom plate to the oven body is achieved by engagement between the engagement hooks and the engagement slots, it is possible to mount and separate the bottom plate easily.

12 Claims, 6 Drawing Sheets

WALL-MOUNTED MICROWAVE OVEN

CROSS-REFERENCE TO RELATED APPLICATIONS

This application claims the benefit of Korean Patent Application No. 2004-3738, filed on Jan. 19, 2004 in the Korean Intellectual Property Office, the disclosure of which is incorporated herein by reference.

BACKGROUND OF THE INVENTION

1. Field of the Invention

The present invention relates to a wall-mounted microwave oven, and more particularly, to a wall-mounted microwave oven in which a bottom plate adapted to be mounted to a lower end of an oven body is simply detachable.

2. Description of the Related Art

Generally, a wall-mounted microwave oven is mounted to a wall at a position above a gas oven. Such a wall-mounted microwave oven not only performs a cooking function similar to that of general microwave ovens, but also performs a function for externally exhausting fumes or smoke rising from the gas oven arranged beneath the microwave oven.

The wall-mounted microwave oven is provided with a bottom plate having an exhaust suction port communicating with an exhaust passage defined in an oven body of the microwave oven, in order to suck air around the gas oven and to externally exhaust the sucked air. An illumination device is also installed at the bottom plate to illuminate a kitchen space beneath the microwave oven. The bottom plate is detachably mounted to a lower end of the oven body, in order to allow the user to clean a lower portion of the oven body or to repair the illumination device, without separating the oven body from a wall. That is, the bottom plate is mounted to the lower end of the oven body by means of a plurality of set screws adapted to be threadedly coupled to the lower end of the oven body, so that it can be separated from the oven body in accordance with separation of the set screws.

However, the conventional wall-mounted microwave oven has a problem in that the mounting of the bottom plate requires the use of a large number of set screws. That is, a large number of assembly processes are required in the coupling of the set screws, so that a degradation in productivity is involved with the manufacture of the microwave oven. Furthermore, there is inconvenience and complexity in the process of detaching and re-attaching the bottom plate, during subsequent use of the microwave oven, to clean the lower portion of the microwave oven or to repair the illumination device, because the set screws must be separated and then re-coupled.

SUMMARY OF THE INVENTION

Accordingly, the present invention provides a wall-mounted microwave oven having a bottom plate adapted to be mounted to a lower end of an oven body and easily detachable.

Additional aspects and/or advantages of the invention will be set forth in part in the description which follows and, in part, will be obvious from the description, or may be learned by practice of the invention.

The foregoing and/or other aspects of the present invention are achieved by providing a wall-mounted microwave oven comprising an oven body, a bottom plate mounted to a lower end of the oven body, and a coupling unit mounting the bottom plate to the lower end of the oven body and comprising a plurality of engagement slots formed through the lower end of the oven body at positions spaced apart from one another, respectively, and a plurality of engagement hooks provided on the bottom plate at positions corresponding to the positions of the engagement slots, to be inserted into and engaged with the engagement slots, respectively.

The coupling unit comprises at least one set screw threadedly coupled, at a lower surface of the bottom plate, to the lower end of the oven body through the bottom plate.

The set screw may extend through an edge portion of the bottom plate between adjacent ones of the engagement hooks arranged at the edge portion.

The engagement hooks and engagement slots may be arranged near respective corners of the bottom plate.

Each engagement hook may comprise a vertical extension portion extending upwardly from an upper surface of the bottom plate by a predetermined length, and a lateral extension portion extending laterally from an upper end of the vertical extension portion by a predetermined length. The lateral extension portions of the engagement hooks may be of a same extension direction.

The engagement slots may are of a size larger than that of the engagement hooks to allow respective lateral extension portions of the engagement hooks to be easily inserted therein. The lateral extension portion of each engagement hook is spaced, at a lower edge thereof, apart from the upper surface of the bottom plate to define a gap larger than a thickness of the lower end of the oven body.

BRIEF DESCRIPTION OF THE DRAWINGS

These and/or other aspects and advantages of the invention will become more apparent and more readily appreciated from the following description of the embodiments, taken in conjunction with the drawings, of which.

DETAILED DESCRIPTION OF THE PREFERRED EMBODIMENTS

Figure 1:
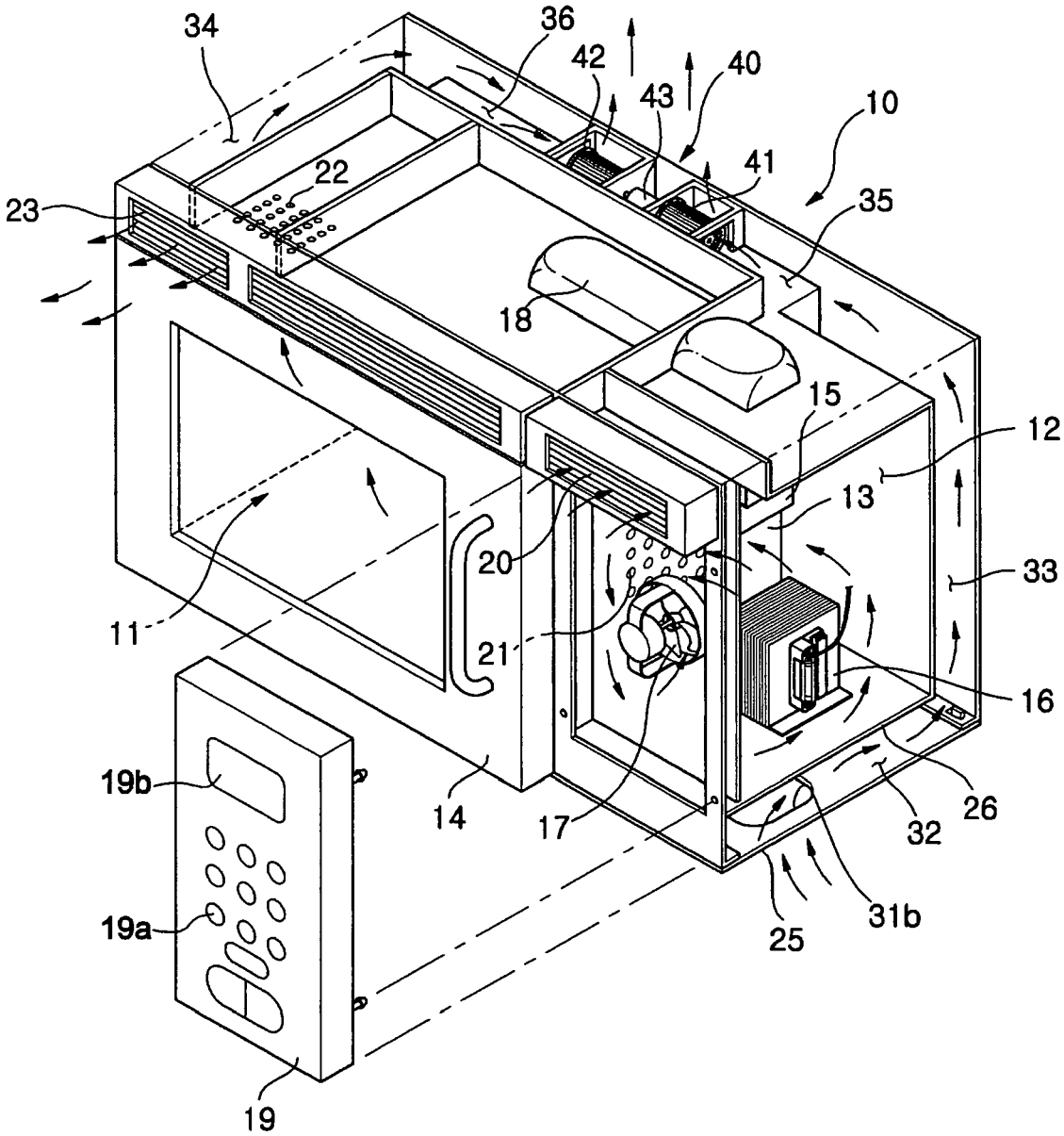
FIG. 1 is a perspective view illustrating a configuration of a wall-mounted microwave oven according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
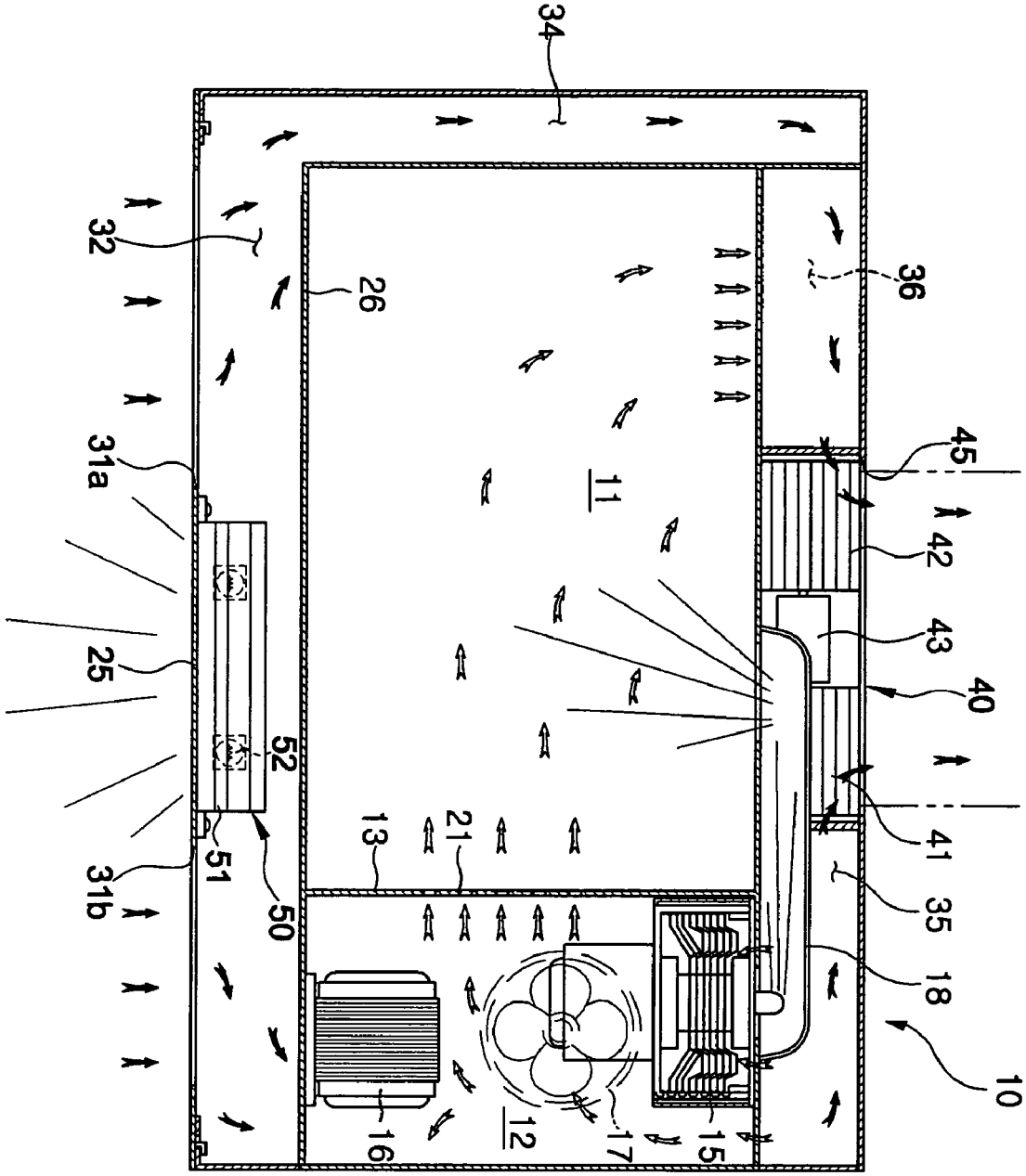
FIG. 2 is a sectional view illustrating an inner configuration of the wall-mounted microwave oven shown in FIG. 1.

In FIGS. 1 and 2, a wall-mounted microwave oven according to an embodiment of the present invention is illustrated. The wall-mounted microwave oven comprises an oven body 10 defined therein with a cooking chamber 11 to cook food and an electric element chamber 12 to receive diverse electric elements. Although not shown, the oven body 10 is fixedly mounted, at a rear wall thereof, to a wall in a kitchen where an oven is installed.

The cooking chamber 11 and electric element chamber 12 in the oven body 10 are partitioned from each other by a partition plate 13. The cooking chamber 11, which is opened at a front end thereof, is opened or closed by a door 14 hingably mounted to a front wall of the oven body 10. The electric element chamber 12 receives a magnetron 15 to supply microwaves into the cooking chamber 11, a high-voltage transformer 16 to apply high voltage to the magnetron 15, and a cooling fan 17 for cooling the interior of the electric element chamber 12. A waveguide 18 is installed to extend along top walls of the electric element chamber 12 and cooking chamber 11. The waveguide 18 guides microwaves emitted from the magnetron 15 to the interior of the cooking chamber 11. An operating panel 19 is mounted to the front wall of the oven body 10 in front of the electric element chamber 12. The operating panel 19 comprises a plurality of operating buttons 19*a* to control various functions of the microwave oven, and a display 19*b* to display an operating state of the microwave oven.

The oven body 10 further comprises a ventilation passage to cool the electric element chamber 12 and ventilation of the cooking chamber 11. The ventilation passage comprises a front air inlet 20 provided at the front wall of the oven body 10 above the operating panel 19 while communicating with the interior of the electric element chamber 12, a plurality of through holes 21 formed at the partition plate 13 adapted to partition the cooking chamber 11 and the electric element chamber 12, a plurality of through holes 22 formed at the top wall of the cooking chamber 11, and a front air outlet 23 provided at the front wall of the oven body 10 above the cooking chamber 11.

With this configuration of the ventilation passage, air is introduced into the electric element chamber 12 through the front air inlet 20 when the cooling fan 17 installed in the electric element chamber 12 operates. After cooling the electric elements received in the electric element chamber 12, the air from the electric element chamber 12 is introduced into the cooking chamber 11 through the through holes 21 of the partition plate 13, and is then externally discharged from the cooking chamber 11 through the through holes 22 and the front air outlet 23. Thus, ventilation of the cooking chamber 11 is achieved.

The oven body 10 further comprises an exhaustion passage to externally exhaust fumes or smoke rising from the oven installed beneath the microwave oven. An exhaustion unit 40 is installed at an upper rear portion of the oven body 10 to exhaust fumes or smoke guided through the exhaustion passage.

The exhaustion passage comprises exhaust inlets 31*a* and 31*b* formed at the bottom plate 25 of the oven body 10, and a lower exhaust passage 32 defined in an opening between the bottom plate 25 of the oven body 10 and bottom walls 26 of the cooking chamber 11 and electric element chamber 12. The exhaustion passage further comprises a first vertical exhaust passage 33 defined in the oven body 10 in a rear of the electric element chamber 12 while extending vertically from the lower exhaust passage 32, a second vertical exhaust passage 34 defined in the oven body 10 at a side of the cooking chamber 11 opposite to the partition plate 13 while extending vertically from the lower exhaust passage 32, and first and second upper exhaust passages 35 and 36 defined at the upper rear portion of the oven body 10 while communicating with the first and second vertical exhaust passages 33 and 34, respectively. With this configuration of the exhaustion passage, fumes or smoke sucked into a bottom portion of the oven body 10 through the exhaust inlets 31*a* and 31*b* can be guided toward the exhaustion unit 40 installed at the upper rear portion of the oven body 10 via the lower exhaust passage 32, first and second vertical exhaust passages 33 and 34, and first and second upper exhaust passages 35 and 36.

The exhaustion unit 40 comprises a first exhaust fan 41 to suck air existing in the first upper exhaust passage 35, and externally exhausting the sucked air, a second exhaust fan 42 to suck air existing in the second upper exhaust passage 36, and externally exhausting the sucked air, and a motor 43 to simultaneously drive the first and second exhaust fans 41 and 42. In FIG. 2, an exhaust outlet 45 is formed at a top wall of the oven body 10 near the exhaustion unit 40 to externally discharge air exhausted through the exhaustion unit 40. The exhaust outlet 45 is connected to an exhaust duct (not shown) installed at a building, upon installing the oven body 10 in a kitchen space provided in the building.

Figure 3:
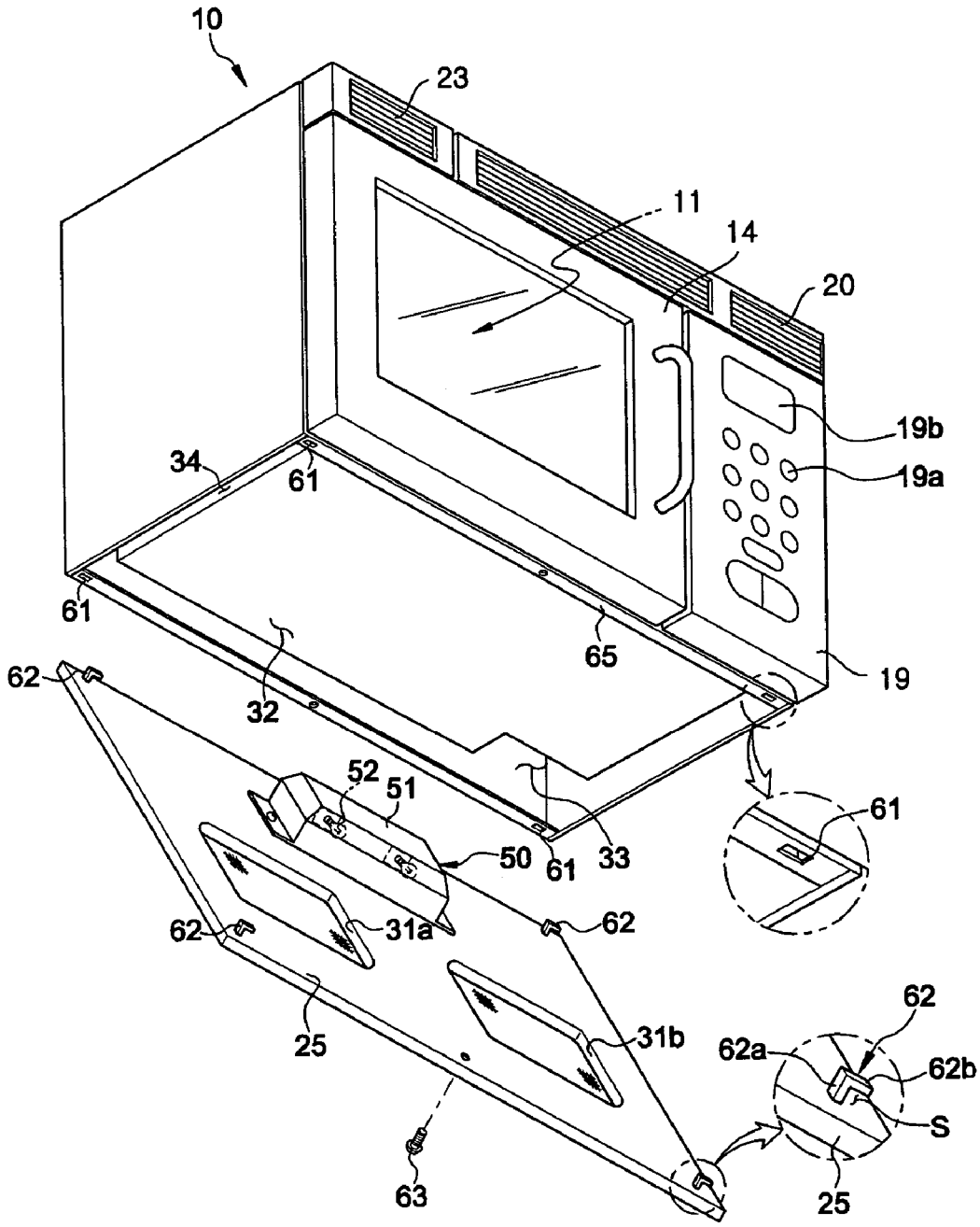
FIG. 3 is a perspective view illustrating a bottom plate mounting structure of the wall-mounted microwave oven shown in FIG. 1.

In FIG. 3, the bottom plate 25 adapted to be mounted to the lower end of the oven body 10 comprises a rectangular panel structure of a size corresponding to that of a bottom portion of the oven body 10. The exhaust inlets 31*a* and 31*b* are formed through a front portion of the bottom plate 25 at opposite sides of the bottom plate 25, respectively. The illumination unit 50 adapted to illuminate the kitchen space beneath the oven body 10 is mounted to a rear portion of the bottom plate 25. The illumination unit 50 comprises a reflection member 51, and a plurality of lamps 52. The reflection member 51 is detachably coupled to an inner surface of the bottom plate 25. Accordingly, the lamps 52, which are arranged inside the reflection member 51, are replaceable.

Figure 6:
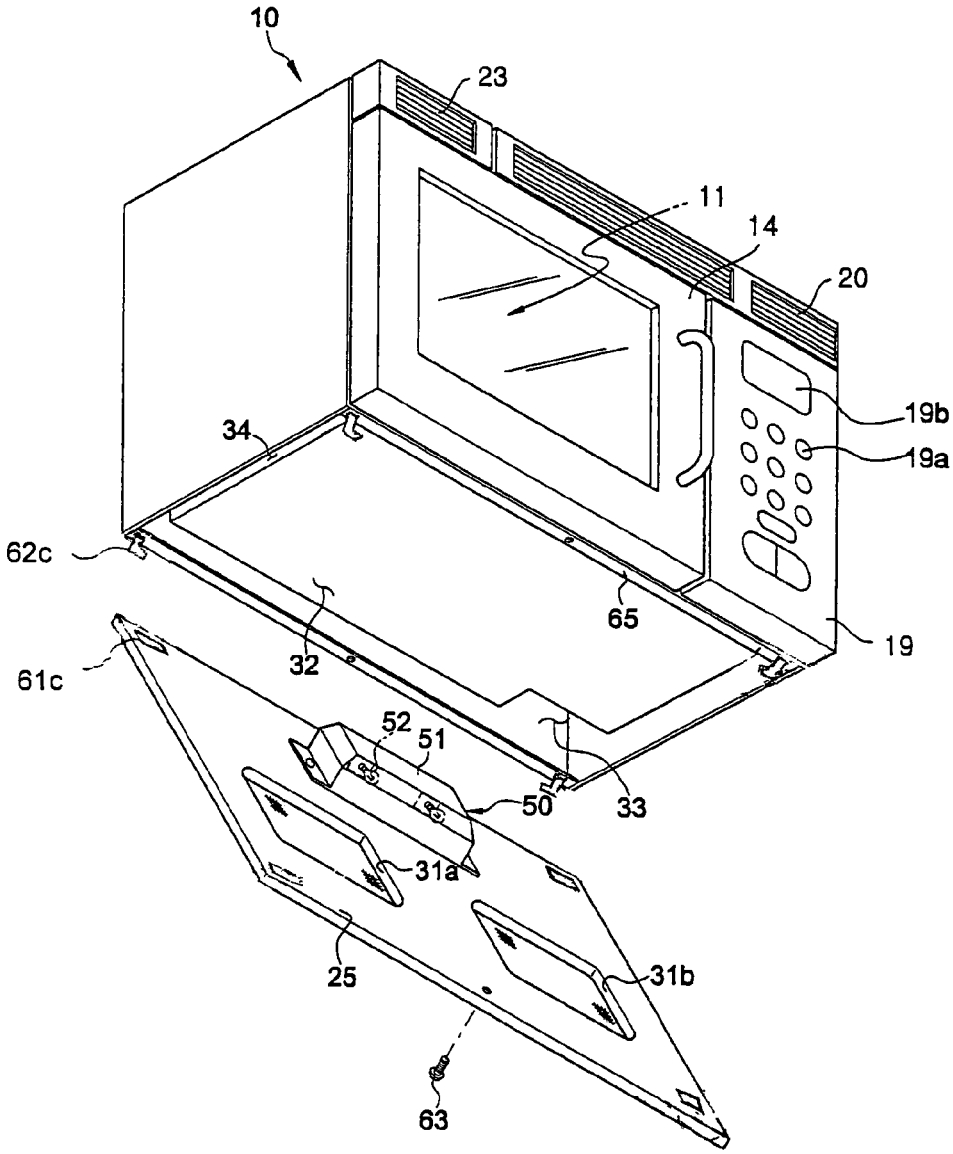
FIG. 6 is perspective view illustrating a configuration of a bottom plate mounting structure of a wall-mounted microwave oven with engagement hooks on a lower surface of the oven body.

The bottom plate 25 is detachably coupled to the lower end of the oven body 10, to allow the user to clean the exhaustion passage in the oven body 10 or to replace the lamps 52 of the illumination unit 50 with new ones, without separating the oven body 10 from the building wall. For such coupling, a plurality of engagement slots 61 are formed at the lower end of the oven body 10. The bottom plate 25 comprises a plurality of engagement hooks 62 at an upper surface thereof to be inserted into and engaged with the engagement slots 61. At the lower surface of the bottom plate 25, set screws 63 are coupled to the lower end of the oven body 10 through the bottom plate 25, respectively, to fix the bottom plate 25 to the lower end of the oven body 10 by the engagement hooks 62 and engagement slots 61. In the illustrated case, the engagement hooks 62 are arranged near respective corners of the bottom plate 25, and the engagement slots 61 are arranged near respective corners of the oven body 10 at the lower end of the oven body 10 in positions corresponding to positions of the engagement hooks 62. In this aspect of the present invention, the set screws 63 are centrally arranged at front and rear edge portions of the bottom plate 25, respectively. However, the engagement hooks 62 and the engagement slots may be located along the bottom plate 25 and the lower end of the oven body 10, respectively, at various positions corresponding to each other. As shown in FIG. 6, engagement hooks 62*c* may also be located on a lower surface of the oven body 10 and the corresponding engagements slots 61*c* may be located on a top surface of the bottom plate 25. In addition, the set screws 63 may be arranged in various positions along the bottom plate 25.

Figure 4:
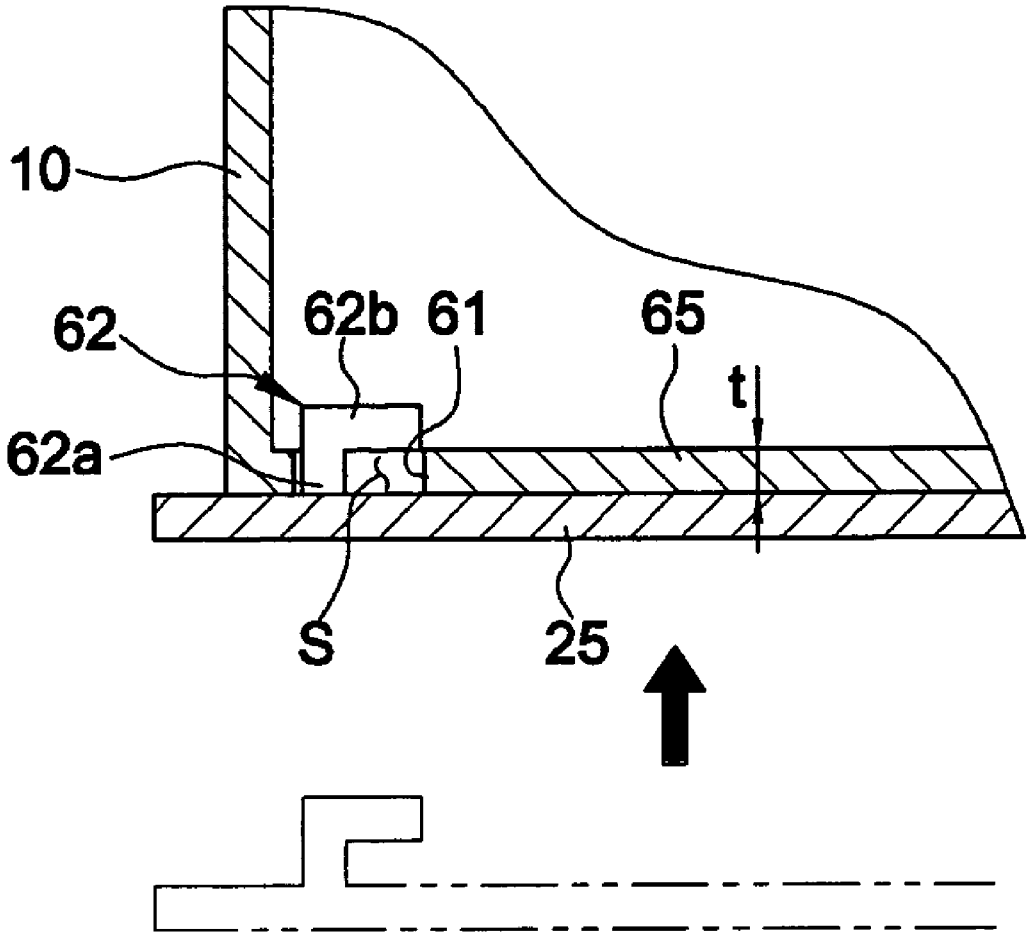
FIG. 4 is a sectional view of the bottom plate mounting structure, illustrating a state in which engagement hooks are inserted into engagement slots, respectively.

In FIGS. 3 and 4, each engagement hook 62 comprises a vertical extension portion 62*a* extending upwardly from the upper surface of the bottom plate 25 by a predetermined length, and a lateral extension portion 62*b* extending laterally from an upper end of the vertical extension portion 62*a*. The lateral extension portions 62*b* of the engagement hooks 62 each comprises a same extension direction. The engagement slots 61 provided at the lower end of the oven body 10 are of a size larger than that of the engagement hooks 62, to allow respective lateral extension portions 62*b* of the engagement hooks 62 to be easily inserted therein. Preferably, the gap s defined between the lower edge of each lateral extension portion 62*b* and the upper surface of the bottom plate 25 is larger than the thickness t of the lower end of the oven body 10. In addition, a length of the lateral extension portion 62*b* is larger than a length of the vertical extension portion 62*a*. In FIGS. 3 and 4, the lower end of the oven body 10 is designated by reference numeral 65.

Figure 5:
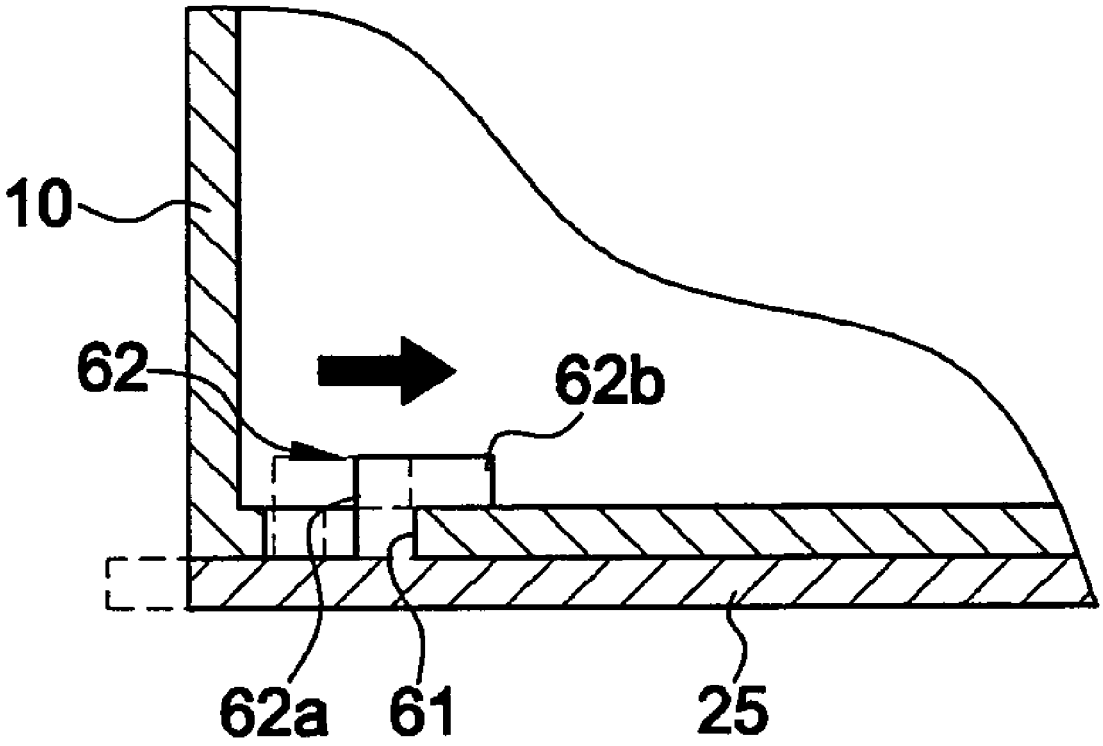
FIG. 5 is a sectional view of the bottom plate mounting structure, illustrating a state in which the engagement hooks are engaged with the engagement slots, respectively.

With the above described configuration, the mounting plate 25 can be simply mounted by simultaneously inserting all engagement hooks 62 into the corresponding engagement slots 61, as shown in FIG. 4, and then shifting the bottom plate 25 in a lateral direction (the right direction as shown in FIG. 5), until the lateral extension portions 62*b* of the engagement hooks 62 are engaged with respective edges of the corresponding engagement slots 61. In this state, the set screws 63 are threadedly coupled to prevent the bottom plate 25 from being separated from the oven body 10. Thus, in accordance with the present invention, it is possible to simply achieve the process of mounting the bottom plate 25, as compared to conventional wall-mounted microwave ovens, because the bottom plate 25 can be mounted by the engagement slots 61 and engagement hooks 62.

When the bottom plate 25 has to be separated from the oven body 10 for cleaning of the exhaustion passage or replacement of the lamps 52 in the illumination device 50, a separation procedure is carried out in a reverse order to that of the above described mounting procedure. That is, the user first separates the set screws 63 from the lower end of the oven body 10, and then shifts the bottom plate 25 in a lateral direction opposite to that of the mounting procedure (the left direction as shown in FIG. 5) until respective engagement hooks 62 are disengaged from the associated engagement slots 61. Thus, the separation of the bottom plate 25 can be simply achieved.

As is apparent from the above description, the wall-mounted microwave oven of the present invention is capable of mounting and separating the bottom plate with respect to the oven body easily because the mounting of the bottom plate to the oven body is achieved by the engagement hooks provided at the bottom plate and the engagement slots provided at the lower end of the oven body.

In addition, it is possible to to clean the exhaustion passage and replace the lamps of the illumination device easily because the bottom plate can be easily detached.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A wall-mounted microwave oven comprising:

an oven body;

a bottom plate mounted to a lower end of the oven body; and a coupling unit for mounting the bottom plate to the lower end of the oven body, and comprising:

a plurality of engagement slots formed through the lower end of the oven body at positions spaced apart from one another, respectively, and a plurality of engagement hooks provided on the bottom plate at positions corresponding to the positions of the engagement slots, to be inserted into and engaged with the engagement slots, respectively, at least one set screw threadedly coupled, at a lower surface of the bottom plate, to the lower end of the oven body through the bottom plate, and wherein the at least one set screw extends through an edge portion of the bottom plate between adjacent ones of the engagement hooks arranged at the edge portion.

2. The wall-mounted microwave oven of claim 1, wherein the engagement hooks and engagement slots are arranged near respective corners of the bottom plate.

3. The wall-mounted microwave oven of claim 1, wherein each of the engagement hooks comprises:

a vertical extension portion extending upwardly from an upper surface of the bottom plate by a predetermined length; and a lateral extension portion extending laterally from an upper end of the vertical extension portion by a predetermined length, the lateral extension portion having a same extension direction as the lateral extension portion of the other engagement hooks.

4. The wall-mounted microwave oven of claim 3, wherein:

the engagement slots are of a size larger than that of the engagement hooks to allow respective lateral extension portions of the engagement hooks to be easily inserted therein; and the lateral extension portion of each engagement hook is spaced, at a lower edge thereof, apart from the upper surface of the bottom plate to define a gap larger than a thickness of the lower end of the oven body.

5. The wall-mounted microwave oven of claim 3, wherein the bottom plate is mounted to the oven body by simultaneously inserting the engagement hooks into the corresponding engagement slots and shifting the bottom plate in a first direction until the lateral extension portions of the engagement hooks are engaged with respective edges of the corresponding engagement slots and fixing the bottom plate to the oven body with screws, to prevent the bottom plate from being separated from the oven body.

6. The wall-mounted microwave oven of claim 5, wherein the bottom plate is separated from the oven body by removing the screws and shifting the bottom plate in a second direction, opposite the first direction, until the respective engagement hooks are disengaged from the corresponding engagement slots.

7. A wall-mounted microwave oven comprising:

an oven body having openings formed on a lower surface thereof; and a bottom plate detachably mounted to a lower end of the oven body and comprising hook portions on an upper surface thereof to be inserted into the openings of the oven body, to allow a user access to a lower portion of the oven body without separating the oven body from a wall;

at least one set screw threadedly coupled, at a lower surface of the bottom plate, to the lower end of the oven body through the bottom plate, and wherein the at least one set screw extends through an edge portion of the bottom plate between adjacent ones of the engagement hooks arranged at the edge portion.

8. The wall-mounted microwave oven of claim 7, wherein each of the hook portions comprises:

a vertical extension portion extending upwardly from the upper surface of the bottom plate by a predetermined length; and a lateral extension portion extending laterally from an upper end of the vertical extension portion by a predetermined length, the lateral extension portion having a same extension direction as the lateral extension portion of the other hook portions.

9. The wall-mounted microwave oven of claim 8, wherein:

the openings are of a size larger than that of the hook portions to allow respective lateral extension portions of the hook portions to be inserted therein; and the lateral extension portion of each hook portion is spaced, at a lower edge thereof, apart from the upper surface of the bottom plate to define a gap larger than a thickness of the lower end of the oven body.

10. A wall-mounted microwave oven comprising:

an oven body having hook portions on a lower surface thereof; and a bottom plate detachably mounted to a lower end of the oven body and comprising openings formed on an upper surface thereof, wherein the hook portions are inserted in the openings, to allow a user access to a lower portion of the oven body without separating the oven body from a wall;

at least one set screw threadedly coupled, at a lower surface of the bottom plate, to the lower end of the oven body through the bottom plate, and wherein the at least one set screw extends through an edge portion of the bottom plate between adjacent ones of the engagement hooks arranged at the edge portion.

11. The wall-mounted microwave oven of claim 10, wherein each of the hook portions comprises:

a vertical extension portion extending downwardly from the lower surface of the oven body by a predetermined length; and a lateral extension portion extending laterally from an end of the vertical extension portion by a predetermined length, the lateral extension portion having a same extension direction as the lateral extension portion of the other hook portions.

12. The wall-mounted microwave oven of claim 11, wherein:

the openings are of a size larger than that of the hook portions to allow respective lateral extension portions of the hook portions to be inserted therein; and the lateral extension portion of each hook portion is spaced, at an upper edge thereof, apart from the lower surface of the oven body, to define a gap larger than a thickness of the bottom plate.

* * * * *